US006360717B1

(12) United States Patent
Chang et al.

(10) Patent No.: US 6,360,717 B1
(45) Date of Patent: Mar. 26, 2002

(54) FUEL INJECTION SYSTEM AND A METHOD FOR OPERATING

(75) Inventors: David Y. Chang, Savoy; David C. Mack, Pontiac, both of IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 09/638,634

(22) Filed: Aug. 14, 2000

(51) Int. Cl.[7] ..... F02M 37/04
(52) U.S. Cl. ..... 123/381; 123/494
(58) Field of Search ..... 123/446, 381, 123/494

(56) References Cited

U.S. PATENT DOCUMENTS

| | | | | |
|---|---|---|---|---|
| 3,483,855 | A | | 12/1969 | Thoma |
| 4,252,097 | A | | 2/1981 | Hartford et al. |
| 4,438,749 | A | | 3/1984 | Schwippert |
| 4,522,177 | A | | 6/1985 | Kawai et al. |
| 4,955,345 | A | | 9/1990 | Brown et al. |
| 5,027,768 | A | | 7/1991 | Saegusa |
| 5,181,494 | A | * | 1/1993 | Ausman ..... 123/446 |
| 5,191,867 | A | | 3/1993 | Glassey |
| 5,231,962 | A | | 8/1993 | Osuka et al. |
| 5,357,912 | A | | 10/1994 | Barnes et al. |
| 5,423,302 | A | | 6/1995 | Glassey |
| 5,542,395 | A | | 8/1996 | Tuckey et al. |
| 5,586,538 | A | | 12/1996 | Barnes |
| 5,848,583 | A | | 12/1998 | Smith et al. |
| 5,896,841 | A | | 4/1999 | Nemoto et al. |
| 6,014,956 | A | | 1/2000 | Cowden et al. |

* cited by examiner

*Primary Examiner*—Thomas N. Moulis
(74) *Attorney, Agent, or Firm*—John J. Cheek

(57) ABSTRACT

The present invention provides a fuel injection system and method of operating the fuel injection system. The fuel injection system includes at least one hydraulically actuated fuel injector fluidly connected with a source of high pressure actuation fluid. A viscosity sensor determines the viscosity of the hydraulically actuated fuel injector. A controller in communication with the fuel injector and the viscosity sensor is configured to determine the rate of change of the viscosity of the high pressure hydraulic actuation fluid. The supply of high pressure actuated fluid to the fuel injector is based, at least in part, on the rate of change of the determined viscosity of the high pressure actuation fluid.

15 Claims, 2 Drawing Sheets

FUEL INJECTION SYSTEM AND A METHOD FOR OPERATING

TECHNICAL FIELD

The present invention relates generally to a fuel injection system having at least one hydraulically actuated fuel injector and, more particularly to controlling a supply of high pressure actuating fluid to the injector.

BACKGROUND ART

In a fuel system having hydraulically actuated electronically controlled unit injectors, such as HEUI injectors available from Caterpillar Inc., high pressure hydraulic actuating fluid drives a plunger to pressurize fuel and thereby inject high pressure fuel from a nozzle. An electronic activator, such as a solenoid, or a piezo-electric device, controls when the high pressure actuating fluid is exposed to the plunger. The amount of fuel injected is controlled by adjusting the duration the electronic actuator is "on".

The viscosity of the actuating fluid effects both the amount of fuel delivered by the injector, and when the fuel pressurization process begins. For example, at cold temperatures the actuating fluid is thicker (more viscous) than at warm temperatures. Therefore, when an electrical signal is delivered to an electronic actuator, the fluid flows into the injector at a relatively slow rate, to drive the plunger. With the actuating fluid moving at a relatively slow rate, there is an increased delay before the injector begins delivering fuel. Furthermore, when the electronic actuator is turned off to stop delivery of the fuel, the reduced flow rate of the actuating fluid results in less than the intended amount of fuel being injected. Hence, with a high viscosity actuating fluid as seen at cold starting temperatures as compared to higher temperature operating conditions, the fuel injection event occurs later than intended due to the slower delivery rate of the actuating fluid. Under these conditions, overall engine performance may be adversely effected, resulting in incomplete combustion, low power, white smoke, unused particulate matter, and NOx.

The viscosity of the actuating fluid is a function of the fluid type, the temperature of the fluid, and the shear rate of the fluid in the hydraulic circuit. In an operating engine, neither the type of fluid, the shear rate, nor the temperature is fixed. The fuel system may use a variety of actuation fluids. For example, a more viscous SAE 15W40 engine oil or a less viscous0W20 engine oil may be used. Also the fuel system operates over a wide range of temperatures, e.g., −45° C. through 120° C.

The viscosity of the actuating fluid changes with a change in shear rate at a given temperature. During cranking at either hot or cold starting conditions, the viscosity of the actuating fluid is temporarily lowered when the flow rate of the fluid is increased and the well sheared actuating fluid enters the actuating fluid circuit. The temporary viscosity loss can not be detected by the engine governor or the vehicle operator. The sudden, temporary loss of viscosity produces a sudden increase in fuel delivery, which in turn creates a rapid change in engine speed.

The reduction in fuel delivery and delays in timing increase as the viscosity of the actuating fluid increases. If the changes in shear rate, which temporarily change the viscosity, are not accounted for, the fuel delivery and timing may be incorrect making it difficult to start and run the engine especially at high viscosities encountered at cold temperatures. If the fuel delivery is too small, or is not delivered at the proper time, the engine may not start or be underpowered. If the fuel delivery is too large the engine structural capabilities may be exceeded, excessive smoke may be produced, and misfire may occur.

The present invention is directed to overcoming one or more of the problems identified above.

DISCLOSURE OF THE INVENTION

In one aspect of the present invention, a method or operating a fuel injection system including at least one hydraulically actuated fuel injector fluidly connected with a source of high pressure hydraulic actuation fluid is disclosed. The method includes the steps of determining the viscosity of the actuation fluid, the rate of change of the viscosity, and controlling the supply of actuation fluid to the fuel injector based, at least in part, on the determined viscosity of the actuation fluid.

In another aspect of the present invention a fuel injection system is disclosed. The fuel injection system includes at least one hydraulically actuated fuel injector fluidly connected with the source of high pressure actuation fluid, a viscosity sensor for determining the viscosity of the high pressure hydraulic actuation fluid, and a controller in communication with the hydraulically actuated fuel injector being adapted to determine the rate in change of the viscosity of the high pressure actuating fluid, and determining a fuel injection command signal in response to the rate of change of the viscosity of the high pressure hydraulic actuation fluid.

BEST MODE FOR CARRYING OUT THE INVENTION

Figure 1:
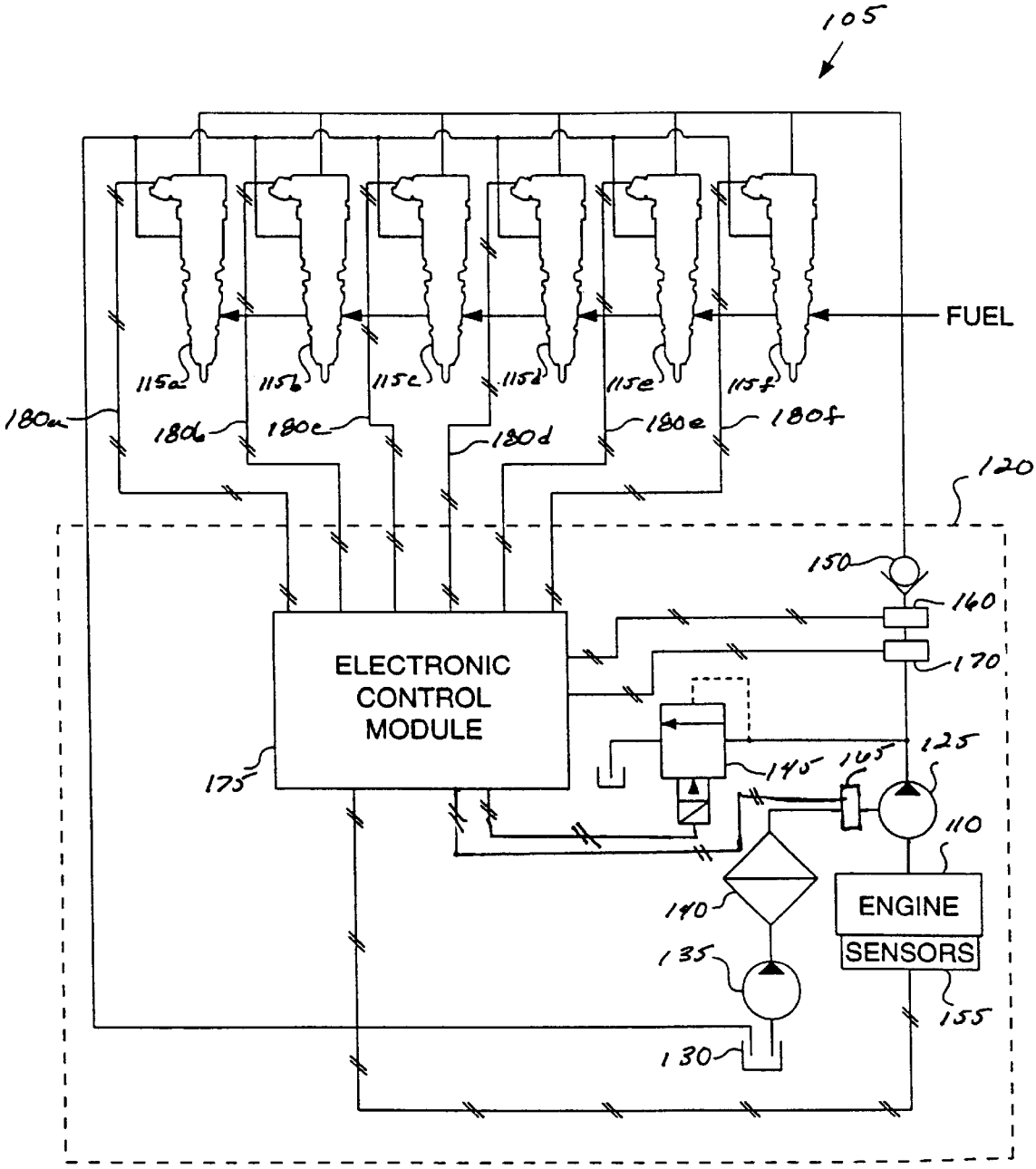
FIG. 1 is a diagrammatic illustration of a fuel system of an engine with which this invention may be used.

The present invention provides a fuel injection system having at least one hydraulically actuated fuel injector. FIG. 1 is an illustration of one embodiment of a fuel system 105 of an engine 110. The fuel system 105 includes at least one fuel injector 115*a–f* for each combustion chamber or cylinder of the fuel system 105. In the preferred embodiment, the fuel injectors are hydraulically actuated electronically controlled unit injectors, such as HEUI injectors available from Caterpillar Inc. Each injector 115*a–f* has an associated solenoid (not shown). In FIG. 1, six unit injectors 115*a–f* are shown, however, the present invention is not limited to use in connection with a six cylinder engine. To the contrary, it may be easily modified for use with an engine having any number of cylinders and unit injectors 115. In addition, this invention may also be used with unit pump rather than unit injector fuel systems.

The fuel system 105 also includes a circuit 120 for supplying actuating fluid to each injector 115. Actuating fluid is required to provide sufficient pressure to cause the unit injectors 115 to open and inject fuel into an engine cylinder. In one embodiment the circuit 120 includes a high pressure pump 125, driven by the internal combustion engine 110. The output of the pump 125 is connected to each fuel injector 115. Low pressure actuating fluid is pumped from the sump 130 by a low pressure pump 135 through a filter 140, which filters impurities from the fluid. Each injector 115 is also connected to the fluid sump 130 in order to return the actuating fluid to the fluid sump 130.

The circuit 120 may include an actuation pressure control valve 145 for regulating the pressure of actuating fluid in the rail in cases where the pump 123 is a fixed delivery pump. Alternately, the pump 125 may be a variable delivery pump, thereby obviating the actuation pressure valve 145. A check valve 150 is also provided.

The fuel system 105 includes an engine speed sensor 155. In one embodiment, the speed sensor 155 reads the signature of a timing wheel applied to the engine camshaft to indicate the engine's rotational position and speed. The engine speed sensor 155 monitors the rotational position of the crankshaft relative to top dead center position and bottom dead center position of the respective cycle or stroke. Other devices for determining the engine speed, such as an accelerometer sensor (not shown), may be substituted. The engine speed sensor 155 generates a speed signal.

The circuit 120 also includes a temperature sensor 160. The temperature sensor 160 senses the temperature of the actuating fluid, and responsively generates a fluid temperature signal. In one embodiment the actuating fluid is petroleum based oil. However, the fluid may be a synthetic oil, fuel, or other type of non-compressible fluid.

The circuit 120 also includes a viscosity sensor 165. The viscosity sensor 165 senses the viscosity of the actuating fluid and responsively generates a viscosity signal. Typically, the viscosity sensor 165, is located proximal to the pump 125, preferably on the input side for the actuating fluid.

The circuit 120 includes a pressure sensor 170. The pressure sensor 170, is typically located between the pump 125, and the injectors 115. The pressure sensor 170 senses the pressure of the actuating fluid in the rail and responsively generates a pressure signal.

The fuel system 105 also includes an electronic control module 175. The controller 175 receives the plurality of generated signals and responsively determines the injection timing for the fuel injectors 115*a–f*. The controller 175 delivers an injection command signal to the solenoid of the appropriate injectors 115. The controller 175 contains software decision logic, a plurality of software look-up tables and/or maps, and information defining the fuel system operational parameters and controls key components accordingly. The injectors 115*a–f* are individually connected to outputs of the controller 175 by electrical connectors 180*a–f* respectively.

Figure 2:
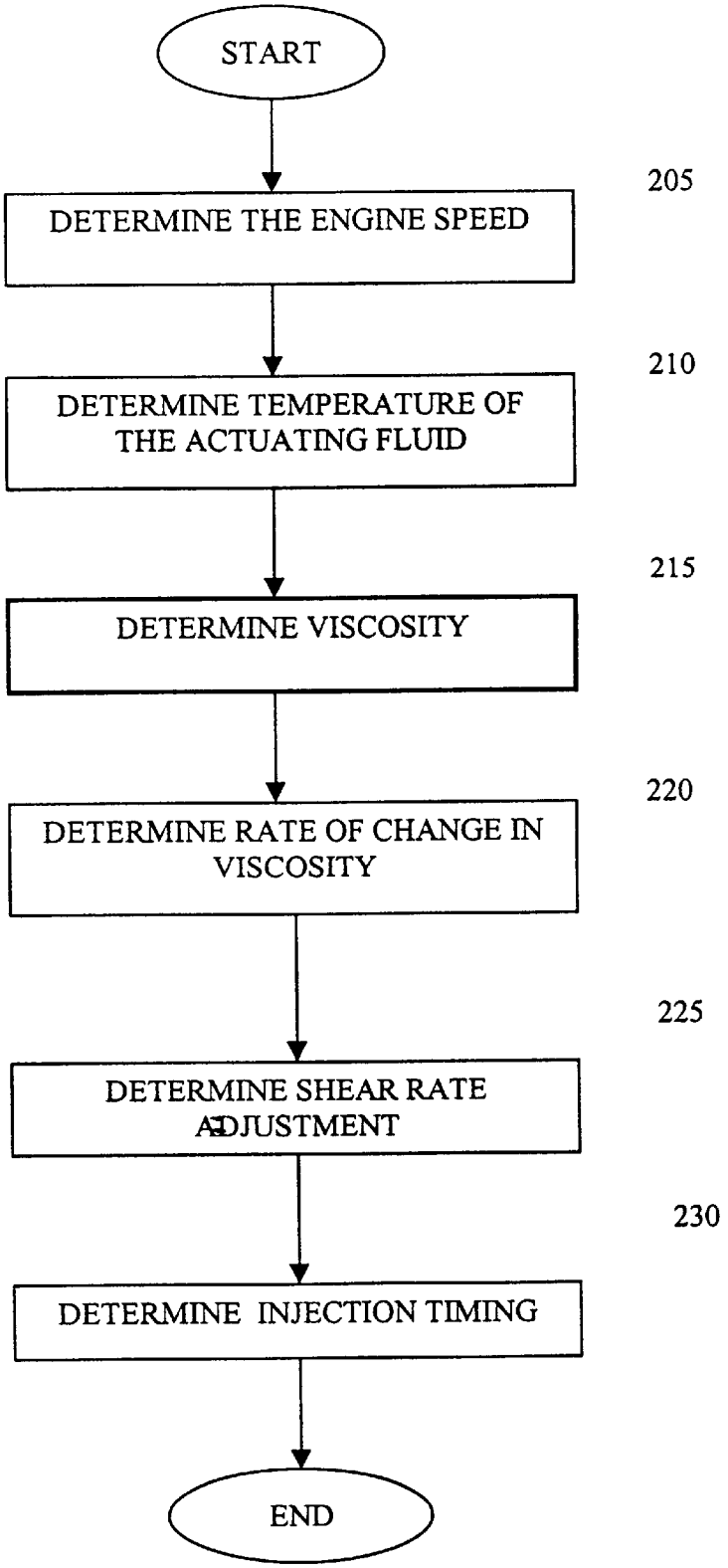
FIG. 2 is an illustration of the method for controlling a fuel injection timing of a fuel injector.

The present invention includes a method for controlling the fuel injection timing of a fuel injector 115 during engine starting and idle operating conditions. The method includes the steps of cranking the engine 110, determining the engine speed, the temperature of the actuating fluid, the viscosity, and the rate of change in the viscosity of the actuating fluid. A shear rate adjustment is determined based on the engine speed, temperature, and viscosity of the actuating fluid. The shear rate adjustment factor and the engines current operating conditions are utilized by the controller 175 in responsively determining injection timing. FIG. 2. illustrates a flow diagram of the present invention.

In a first control block 205, the engine speed is sensed by the engine speed sensor 155. An engine speed signal is produced and delivered to the electronic controller 175.

In a second control block 210, the temperature of the actuating fluid is sensed by the temperature sensor 160, and a temperature signal indicative of the temperature of the actuating fluid is delivered to the controller 175.

In a third control block 215, the viscosity of the actuating fluid is sensed by the viscosity sensor 165, and a viscosity signal indicative of the viscosity of the actuating fluid is delivered to the controller 175. Viscosity sensors that can be used in the fuel injection system for producing signals indicative the fluid being sensed, are well know in the art. One example of a viscosity sensor that may be used is the type that determines viscosity as a function of the pressure drop of a fluid flow over an orifice. Some other examples of sensors that may be used are that type using ultra sonic waves to determine viscosity, or the viscosity detection device disclosed in U.S. Pat. No. 5,896,841.

In a fourth control block 220, the rate of change in the viscosity, specifically a gradual change versus a step change, is determined. The rate of change in viscosity can be calculated or can be determined by a table/map based on actuating fluid consumption rate and engine idling conditions such as engine load. An actuating fluid consumption rate is a function of the amount of fluid in the actuating fluid circuit 120 between the pump 125 and the injectors 115*a–f*, the engine speed, and the current injection delivery time. The rate of change in viscosity is used to determine when the sheared down oil will reach the injectors. The greater the shear rate in the actuating fluid is, the greater the rate of change in the viscosity of the actuating fluid will be.

In a fifth control block 225, a shear rate adjustment associated with the change in viscosity due to fluid shear rate change is determined. In one embodiment, the shear rate adjustment is determined from maps or look-up tables illustrating the shear rate adjustment relative to a given actuating fluid temperature as a function of engine load. In another embodiment the shear rate adjustment may be dynamically calculated.

Each of the shear rate adjustment maps or tables, for a given fluid temperature, contains empirically obtained data for a plurality of viscosity measurements taken during engine operating conditions from zero to full engine load. A map/table can be produced for each actuating fluid temperature at 5° increments in a range of −45° C. through 120° C. The temperature range and increments are dependent on the size and type of engine, and that engines operating parameters.

Table 1 shown below illustrates one embodiment of a shear rate adjustment table. Table 1 has data for determining the shear rate adjustment associated with viscosity measured in the actuating fluid circuit 120 at a range of engine loads, for a given temperature. For the table below: "X" is a temperature in the range of −45° C. to 120° C.; "v" is the measured viscosity of the actuating fluid; "Engine Load" is in increments from zero to full engine load; and ShrAdj is the shear rate adjustment.

TABLE 1

| | Temperature X° C. | | | | |
|---|---|---|---|---|---|
| | Engine Load #1 | Engine Load #2 | Engine Load #3 | . . . | Engine Load #n |
| v1 | ShrAdj 11 | ShrAdj 12 | ShrAdj 13 | | ShrAdj 1n |
| v2 | ShrAdj 21 | ShrAdj 22 | ShrAdj 23 | | ShrAdj 2n |
| v3 | ShrAdj 31 | ShrAdj 32 | ShrAdj 33 | | ShrAdj 3n |
| . | | | | | |
| . | | | | | |
| . | | | | | |
| vn | ShrAdj n1 | ShrAdj n2 | ShrAdj n3 | | ShrAdj nn |

The shear rate adjustment tables/maps are stored in the electron controller 175. During the operation of the present invention, the controller 175 receives the engine speed signal, the fluid temperature signal, the and the fluid viscosity signal.

In a sixth control block 230, an injection command signal is produced by the controller 175 in response to the engine speed, the temperature and viscosity of the actuating fluid, the viscosity rate of change, and the shear rate adjustment. The control loop will be repeated for each injection cycle. In this manner, the injection timing may vary in accordance with the temporary viscosity change due to fluid shear rate change during hot or cold engine starting and idle conditions.

Other aspects, objects, and advantages of the present invention can be obtained from a study of the drawings, the disclosure, and the claims.

Industrial Applicability

The present invention provides an apparatus and method for controlling the fuel injection timing of a fuel injector during engine starting and idle operating conditions. In the preferred embodiment the fuel injector is a hydraulically-actuated unit injector (HEUI).

The engine speed is sensed and an engine speed signal indicative of the engine speed is generated. The temperature of the actuating fluid is sensed and an actuating fluid temperature signal is generated. A rate of change in viscosity, be it a gradual change or a step change, is determined based on engine speed, actuating fluid temperature and viscosity. A shear rate adjustment is determined dependent on the rate of change of the viscosity. The injection timing, the time the injection starts or the duration of the injection is adjusted in accordance with the shear rate adjustment and current engine operating parameters.

Other aspects, objects, and advantages of the present invention can be obtained from a study of the drawings, the disclosure, and the claims.

What is claimed is:

1. A method of operating a fuel injection system including at least one hydraulically actuated fuel injector fluidly connected with a source of high pressure actuation fluid, the method comprising the steps of:

determining the viscosity of the high pressure actuation fluid;

determining a rate in change of the viscosity of the high pressure actuation fluid; and, controlling the supply of high pressure actuated fluid to the fuel injector based, at least in part, on the rate of change of the determined viscosity of the high pressure actuation fluid.

2. A method, as set forth in claim 1, the fuel injector being located in an engine, wherein the step of determining a rate of change of the viscosity of the high pressure actuation fluid further comprises the steps of:

determining a rate of fuel consumption;

determining an engine operating condition; and, dynamically calculating the rate of change of the viscosity of the high pressure actuation fluid based on the rate of fuel consumption and the engine operating condition.

3. A method, as set forth in claim 1, the fuel injector being located in an engine, wherein the step of determining a rate of change of the viscosity of the high pressure actuation fluid further comprises the steps of:

determining a rate of fuel consumption;

determining an engine operating condition;

comparing the rate of fuel consumption and the engine operating condition with at least one of a plurality of maps; and determining the rate of change of the viscosity of the high pressure actuation fluid in response to the comparison.

4. A method, as set forth in claim 1, the fuel injector being located in an engine, wherein the step of determining a rate of change of the viscosity of the high pressure actuation fluid further comprises the steps of:

determining a rate of fuel consumption;

determining an engine operating condition;

comparing the rate of fuel consumption and the engine operating condition with at least one of a plurality of tables; and determining the rate of change of the viscosity of the high pressure actuation fluid in response to the comparison.

5. A method, as set forth in claim 1, further comprising the step of determining a shear rate adjustment of the high pressure actuation fluid.

6. A method, as set forth in claim 5, the fuel injector being located in an engine, wherein the step of determining a shear rate adjustment of the high pressure actuation fluid further comprises the steps of:

determining an engine load;

comparing the temperature of the actuating fluid with at least one of a plurality of shear rate tables and responsively selecting a shear rate table; and, determining the shear rate adjustment in response to the viscosity of the high pressure actuation fluid, the engine load, and the selected shear rate table.

7. A method, as set forth in claim 5, the fuel injector being located in an engine, wherein the step of determining a shear rate adjustment of the high pressure actuation fluid further comprises the steps of:

determining an engine load;

comparing the temperature of the actuating fluid with at least one of a plurality of shear rate maps and responsively selecting a shear rate map; and, determining the shear rate adjustment in response to the viscosity of the high pressure actuation fluid, the engine load, and the selected shear rate map.

8. A fuel injection system, comprising:

a source of high pressure actuation fluid;

at least one hydraulically actuated fuel injector fluidly connected with the source of high pressure actuation fluid;

a viscosity sensor for determining the viscosity of the high pressure hydraulic actuation fluid; and, a controller in communication with the hydraulically actuated fuel injector being adapted to determine a rate in change of the viscosity, wherein the controller is adapted to responsively produce a fuel injection command signal in response to the rate of change of the viscosity of the high pressure hydraulic actuation fluid.

9. A fuel injector system, as set forth in claim 8, further comprising:

an engine speed sensor adapted to sense an engine speed, and responsively produce an engine speed signal; and, a temperature sensor for determining the temperature of the high pressure hydraulic actuation fluid, wherein the controller being adapted to receive the output from the engine speed sensor and the temperature sensor, and the controller responsively determines a shear rate adjustment.

10. A fuel injection system, as set forth in claim 9, wherein the controller is adapted to determine a rate of fuel consumption, and to determine a rate of change of the viscosity in response to the engine speed signal and the rate of fuel consumption.

11. A fuel injection system, as set forth in claim 10, wherein the controller is adapted to determine an injection command signal in response to the rate of change of the viscosity and the shear rate adjustment.

12. A fuel injection system, as set forth in claim 10, wherein the controller further comprises at least one of a plurality of predetermined viscosity maps as a function of the engine speed and the rate of fuel consumption, the rate of change of the viscosity being determined in response to the at least one predetermined viscosity maps.

13. A fuel injection system, as set forth in claim 10, wherein the controller further comprises at least one of a plurality of predetermined viscosity tables being a function of the engine speed and the rate of fuel consumption, wherein the rate of change of the viscosity being determined in response to the at least one predetermined viscosity tables.

14. A fuel injection system, as set forth in claim 10, wherein the controller further comprises at least one of a plurality of predetermined shear rate maps being a function of the high pressure actuation fluid temperature, the engine speed, and the viscosity of the high pressure actuation fluid, wherein the rate of change of the viscosity being determined in response to the at least one predetermined maps.

15. A fuel injection system, as set forth in claim 10, wherein the controller further comprises at least one of a plurality of predetermined shear rate tables being a function of the high pressure actuation fluid temperature, the engine speed, and the viscosity of the high pressure actuation fluid, wherein the rate of change of the viscosity being determined in response to the at least one predetermined tables.

* * * * *